United States Patent [19]

Drejza et al.

[11] 4,106,873

[45] Aug. 15, 1978

[54] DISK PRINTER INKING MECHANISM

[75] Inventors: John Edward Drejza, Endwell; Joseph Vincent Riley, Vestal, both of N.Y.

[73] Assignee: International Business Machines Corporation, Armonk, N.Y.

[21] Appl. No.: 777,257

[22] Filed: Mar. 14, 1977

[51] Int. Cl.[2] ..... B41J 27/06

[52] U.S. Cl. ..... 400/470; 400/145.1

[58] Field of Search ..... 101/93.15, 93.16, 93.17, 101/93.19, 323, 331; 197/49, 53, 54, 150

[56] References Cited

U.S. PATENT DOCUMENTS

| | | | |
|---|---|---|---|
| 3,526,309 | 9/1970 | Marion et al. | 197/150 |
| 3,613,856 | 10/1971 | Reed | 197/54 |
| 3,669,237 | 6/1972 | Wagner | 101/93.16 X |
| 3,724,631 | 4/1973 | Kaczeus | 197/49 |
| 3,913,772 | 10/1975 | Bowdle et al. | 197/54 |

OTHER PUBLICATIONS

IBM Tech. Disc. Bulletin, by F. L. Vichich, vol. 16, No. 3, Aug. 1973, p. 951.

*Primary Examiner*—Paul T. Sewell

*Attorney, Agent, or Firm*—Elmer W. Galbi

[57] ABSTRACT

A serial disk printer which includes an ink roll is disclosed. During printing, the print disk is continuously rotated at a constant speed as it moves across the print line. The motion of the carrier across the print line does not begin until rotation of the print disk has been brought up to speed. In order to avoid unnecessary delay, the rotation of the print disk is not immediately stopped at the end of each line of printing. Instead, after each line of printing the carrier is returned to a home position and the disk is rotated for several seconds so that in the event printing of another line is required shortly after the completion of a line of printing the disk is still rotating and there will not be any delay before printing can begin. Ink is applied to the print disk by an ink roll which is in contact with the print disk. A mechanism is provided to lift the ink roll from the print disk while the disk is idling in home position. Thus, there is no wear on the ink roll while it is in home position. In a second embodiment of the invention, an added element keeps the ink roll rotating when the carrier is in home position so that there is minimal relative motion between the ink roll and the print disk when they are brought into contact.

2 Claims, 4 Drawing Figures

DISK PRINTER INKING MECHANISM

SUMMARY OF THE INVENTION

Description of the Prior Art

Serial printers with constantly rotating print disks are well known in the prior art. For example, such a printer is shown in U.S. Pat. No. 3,461,235 (Willcox), issued Aug. 12, 1969. One such printer which is commercially available is the IBM 3612 Passbook and Document Printer.

It is also known that ink can be efficiently provided to a print disk by use of an ink roll. The commercially available IBM 3612 Passbook and Document Printer includes such an ink roll.

The prior art also shows printers where the ink roll can be moved to an inoperative position. For example, U.S. Pat. No. 3,526,309 (Marion) shows a printer where the ink roll is only operative periodically. This patent shows a serial printer wherein ink is supplied to the print wheel from a transfer roll which, in turn, receives ink from an ink roll. In the printer shown in this reference, the ink roll is not engaged and supplying ink while printing is taking place. Instead, the ink roll is engaged with the transfer roll when the carrier is returned to its home position; however, a groove in the transfer roll prevents ink from being applied to the print wheel in the home position. It should be specifically noted that with the apparatus shown in this reference, the ink roll is subject to wear while the printer idles in home position. Furthermore, the apparatus shown in this reference for applying ink is quite complex.

Other references showing ink rolls include, for example, U.S. Pat. Nos. 3,253,542 (McDonough), 3,296,962 (Gopperton), 3,826,191 Pittis, 3,785,288 (Hunter), and 3,745,920 (McKay). Examples of references showing mechanical components similar to some of the components applicant uses include U.S. Pat. No. 3,080,038 (Spalla), IBM Technical Disclosure Bulletin, Vol. 17, No. 4, September 1974, page 1122, Vol. 18, No. 4, September 1975, page 1118, and Vol. 16, No. 3, August 1973, page 951. However, taken alone or together, these references do not show or suggest the applicants' novel combination of elements. These references do not teach how to achieve an increased ink roll life and increased overall response time as does the applicants' invention.

OBJECTS OF THE INVENTION

An object of the present invention is to provide an improved inking mechanism for a constantly rotating disk printer.

Another object of the present invention is to provide an improved printer wherein ink roll life is substantially improved.

Still another object of the present invention is to provide an ink roll mechanism for a serial disk printer wherein no wear will take place on the ink roll while the print is idling at the beginning of a line.

Yet another object of the present invention is to improve the overall response time of a constantly rotating disk printer without decreasing ink roll life.

GENERAL DESCRIPTION OF INVENTION

Replacement of an ink roll is a relatively simple operation. However, over a period of time the cost of ink rolls can be substantial and the inconvenience to the operator can be a negative factor in customer acceptability of the printer. It is thus highly desirable to minimize wear on ink rolls. Applicants' invention is directed toward minimizing ink roll wear and toward extending the life of the ink rolls.

In serial printers with constantly rotating disks, such as those where this invention is applied, the disk must be brought up to speed prior to the time that the carrier begins traversing the print line. In order to minimize the amount of delay prior to the initiation of printing, when a line of printing is completed, the carrier is returned to a home position and rotation of the disk is maintained at normal speed for some period of time. In this way, if another line of printing is called for during the interval while the disk is still rotating, printing can begin immediately. Applicants recognized that a significant amount of needless wear of the ink roll takes place during the time when the carrier is in home position and the print wheel is rotating prior to the initiation of printing. Applicants' invention is directed toward the elimination of this needless wear on the print roll. Furthermore, since applicants eliminate the wear on the print roll while the print disk is idling in home position, they can maintain the disk rotating for a longer period of time in the home position, thereby increasing the probability that the disk will still be rotating when another line of printing is called for.

Applicants eliminate wear on the ink roll when the printer is in home position by use of novel ink roll support bracket and an actuator which is attached to the frame of the machine. When the carrier is moved to the home position, the actuator interacts with the ink roll support bracket to automatically lift the ink roll from contact with the print disk. Thus, when the carrier is in home position the ink roll is disengaged and there is no wear on the ink roll while the printer idles in home position.

Since there is no wear on the ink roll when the printer is idling in home position, the printer can be allowed to idle in home position for longer periods of time thereby increasing the probability that the disk will already be up to speed when another line of printing is called for. The net result is to shorten the response time of the overall system.

In a second embodiment of the invention, a relatively large diameter friction disk is attached to the ink roll so that even when the ink roll is disengaged from the print disk the friction disk still makes contact with the print disk and the ink roll rotational velocity is maintained. In this way, when the ink roll is brought back into contact with the print disk, the ink roll and the print disk have substantially the same velocity and the frictional wear is minimized. The edge portion of the friction disk is slanted so that the thickness of the friction disk decreases as one moves further out on the edge of the disk. The slanted edge insures that the friction disk always engages the inside of the print wheel, hence, the ink roll tangential velocity always equals the velocity of the surface of the print disk which is being inked.

The foregoing and other objects, features and advantages of the invention will be apparent from the following more particular description of preferred embodiments of the invention, as illustrated in the accompanying drawings.

DETAILED DESCRIPTION

Figure 1:
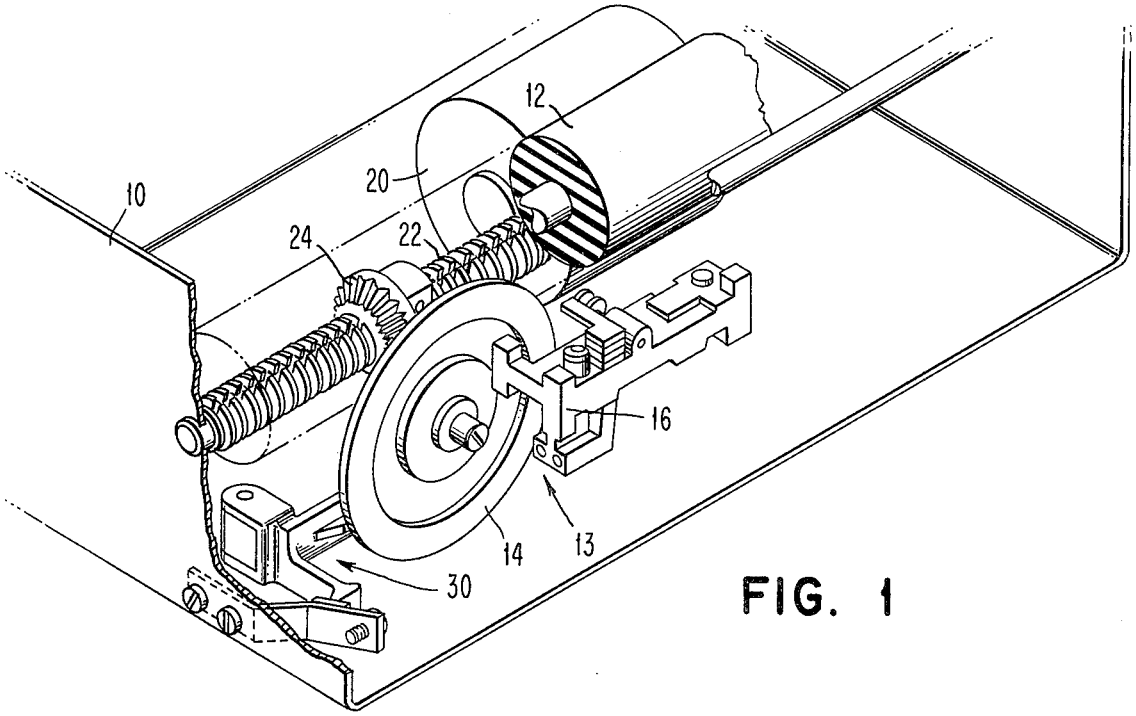
FIG. 1 is an overall view of a printer including the present invention.

An overall view of the first embodiment of the present invention is shown in FIG. 1. This embodiment includes a frame 10 which is shown in schematic form, a platen 12, a carrier 13, a print disk 14 and a hammer mechanism 16. The print disk 14 is driven from a motor 20 through a belt (not shown), a threaded drive shaft 22 and a beveled gear 24. A split nut (not shown in detail) is attached to beveled gear 24 in such a manner that the motion of drive shaft 22 not only rotates print disk 14, but also moves the carrier 13 across the platen 12. The details of the print disk drive mechanism and of the print hammer 16 are not shown or described in detail herein since the details of these parts do not constitute a part of the present invention and, furthermore, they are part of commercially available products, such as the IBM 3612 Passbook and Document Printer.

The printer operates as follows. Print disk 14 is rotated at a relatively high velocity as the carrier 13 is moved across the print line. Actuation of hammer mechanism 16 is synchronized with the rotation of print disk 14 so that a selected character is printed in a particular print position by actuating the hammer mechanism 16 at the appropriate time.

A relatively large amount of energy is required to accelerate the print disk 14 from a stopped condition to print velocity and it thus requires a relatively long period of time to accelerate the print disk 14 from a stopped condition to print velocity.

When one line of printing is finished, the carrier 13 is returned to a home position at the left margin and rotation of the print disk 14 is maintained at print velocity for several seconds. If printing of another line is called for during the interval where the disk is in home position rotating at print velocity, printing of this next line can begin almost immediately. After idling the print disk for several seconds in home position, if no further printing is called for, the motor 20 is stopped and the print disk coasts to a stop. Thereafter, when the next line of printing is called for, there is a several second delay before the print disk can be brought up to print velocity so that printing can begin.

Figure 2:
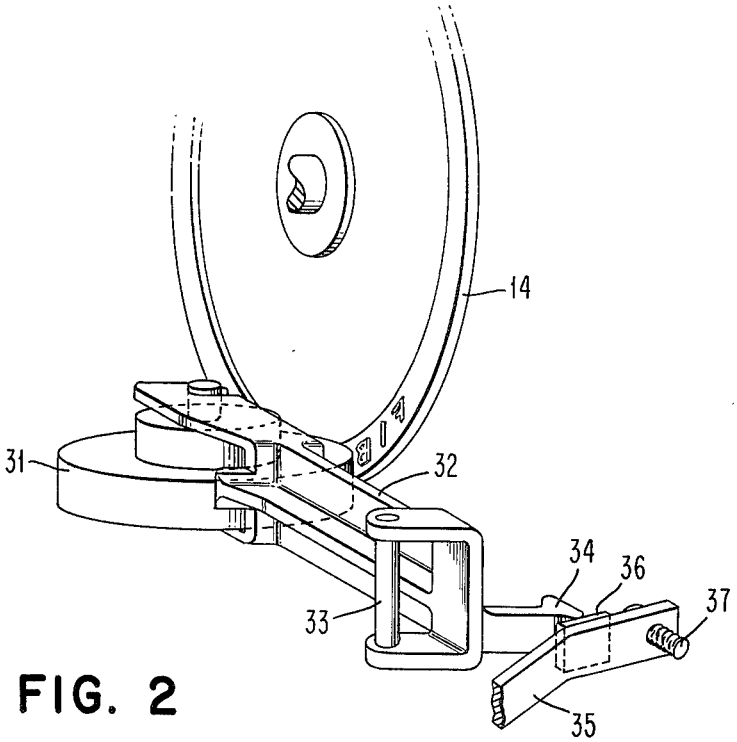
FIG. 2 is an isometric view of a first embodiment of the present invention.

The present invention is directed toward the mechanisms for applying ink to the print disk 14. This mechanism is generally indicated by numeral 30 in FIG. 1. A first embodiment of this mechanism is shown in detail in FIG. 2.

The inking mechanism includes an ink roll 31 which is mounted on a support bracket 32. Support bracket 32 includes a pivot 33 and a lever arm 34. Pressure on lever arm 34 will pivot the support 32 about pivot 33 and moves ink roll 31 away from contact with print disk 14. An actuator 35 is mounted on frame 10. When the carrier 13 is moved to the home position, actuator 35 is brought into contact with lever arm 34, thereby pivoting the support 32 about pivot 33 and removing the ink roll 31 from contact with disk 14. A cushion 36 reduces noise and the wear on the lever arm 34. Set screw 37 which pushes against frame 10 adjusts the position of actuator 35 so that the amount of lift off can be adjusted.

Utilizing the present invention, the print wheel 14 can be allowed to idle in home position for a longer period of time since the ink roll is not engaged while the carrier is in home position. Since the print wheel can be kept at idle in home position for a longer period it increases the probability that the disk will already be up to speed when printing is called for and it eliminates the delay which would be required if one had to wait to bring the print wheel up to print speed.

The present invention is particularly useful in applications, such as the IBM 3612 Passbook and Document Printer, which include a plurality of print disks. In such printers, under many circumstances one printer is utilized several times prior to the utilization of the second printer. Added costs would be involved in turning one printer off while it was not being utilized for printing. On the other hand, if the ink rolls were left in contact with the print disks during this idle time, there would be substantial needless wear on the ink roll. This needless wear on the ink roll is eliminated by the present invention.

Figure 3:
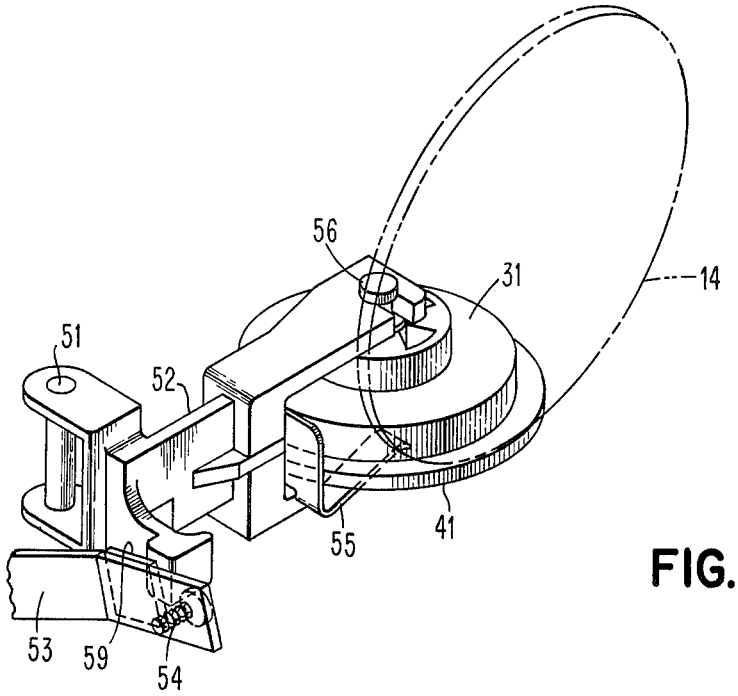
FIG. 3 is a schematic embodiment of a second embodiment of the present invention.
Figure 4:
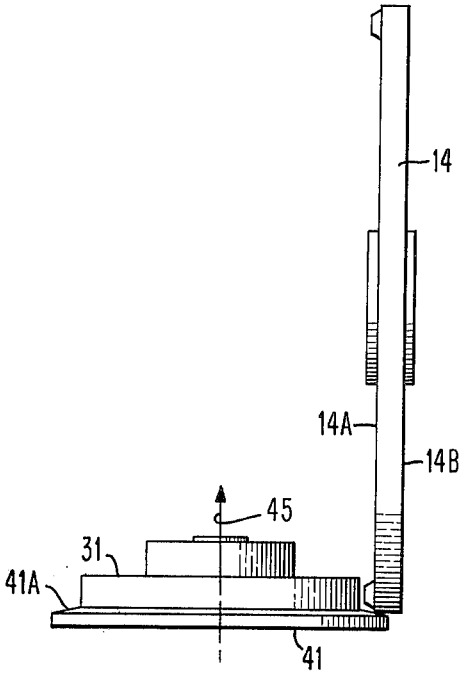
FIG. 4 is an isometric view of the second embodiment of the present invention.

A second embodiment of the present invention is shown in FIGS. 3 and 4. The difference between the first and second embodiment is that the second embodiment has a friction disk 41 attached to the side of ink roll 31. As shown in FIG. 4, friction disk 41 engages the side of print disk 14. FIG. 4 illustrates the relationship between the ink roll 31, friction disk 41 and print disk 14 when the ink roll 31 in its disengaged position, that is when ink roll 31 has been "lifted off" print disk 41. It is noted that flange 41 continues to engage the edge of print disk 41 even though ink roll 31 is removed from print disk 14. The edge 41A of friction disk 41 is beveled so that the contact between friction disk 41 and print disk 14 is along the inside edge 14A of print disk 14. The reason for this is that if friction disk 41 were flat, it might engage edge 14B of print disk 14, thereby causing the print roll 31 to rotate at a higher velocity.

The purpose of friction disk 41 is to maintain the rotational velocity of ink roll 31 even when the ink roll 31 is not in contact with the print disk 14. In this way, when the ink roll 31 is brought back into engagement with print disk 14, there is minimal amount of slippage and hence a minimum amount of wear on ink roll 31. A spring 55 represented by arrow 45 in FIG. 4 biases the side of friction disk 41 against the edge of print disk 14.

The details of the second embodiment are shown in FIG. 3. The mechanism includes a pivot 51, a bifurcated bracket 52, and an actuator arm 53. The actuator arm 53 is attached to the frame 10. The location of the actuator arm 53 relative to the frame 10 can be adjusted by means of a set screw 54. The pivot 51, bracket 52, actuator arm 53 and set screw 54 are similar to the first embodiment. Ink roll 31 is fixedly attached to frictional disk 41. Both ink roll 31 and frictional disk 41 are slideably mounted on a shaft 56 which is attached to bifurcated frame 52. A spring 55 biases the combined ink roll 31 and friction disk 41 up against print disk 14. Spring 55 could be replaced by a coil spring.

The edge 41A of friction disk 41 is beveled at about 3°. It is noted that in FIGS. 3 and 4, the bevel is exaggerated for the purposes of illustration. It is noted that ink roll 31 could be a commercially available ink roll of relatively standard design.

While the invention has been particularly shown and described with reference to preferred embodiments thereof, it will be understood by those skilled in the art that the foregoing and other changes in form and details may be made therein without departing from the spirit and scope of the invention.

We claim:

1. In a printer having, a platen, a constantly rotating print disk, a carrier for moving said print disk across said platen, said carrier having a home position at one end of said platen, said carrier being returned to said home position when a line of printing is complete and prior to the initiation of another line of printing, an ink roll adapted to apply ink to said print disk, the improvement comprising, a friction disk attached to one side of said ink roll, said friction disk having a diameter larger than said ink roll, means for moving said ink roll away from said print disk when said carrier is returned to said home position, whereby there is no wear on said ink roll while said carrier is in home position, said friction disk remaining in contact with said print disk even when said ink roll is removed from contact with said ink roll whereby, there is no relative velocity between said ink roll and said print disk even when said ink roll is removed from contact with said print disk.

2. The combination recited in claim 1 wherein said friction disk has a tapered edge so that the friction disk always engages the side of the print wheel nearest the ink roll, and wherein said ink roll and friction disk are slideably mounted on a shaft, and a spring is positioned to bias said ink roll against said friction disk, thereby maintaining said friction disk in contact with the edge of said print disk.

* * * * *